US006164408A

United States Patent [19]

Lamm et al.

[11] Patent Number: 6,164,408

[45] Date of Patent: Dec. 26, 2000

[54] PLENUM MOUNTED, FLAT PANEL MASKING LOUDSPEAKER SYSTEM AND METHOD FOR MOUNTING A MASKING LOUDSPEAKER IN A CEILING PLENUM

[75] Inventors: Michael E. Lamm, High Ridge; Thomas J. Johnson, Chesterfield; Joseph A. Ferrante, Wildwood, all of Mo.

[73] Assignee: Atlas Sound, Ennis, Tex.

[21] Appl. No.: 09/265,664

[22] Filed: Mar. 10, 1999

[51] Int. Cl.[7] ..... E04B 1/99

[52] U.S. Cl. ..... 181/30; 181/150; 381/73.1

[58] Field of Search ..... 181/30, 150, 157, 181/173, 199, 206; 381/71.7, 71.4, 423, 431, 73.1

[56] References Cited

U.S. PATENT DOCUMENTS

| | | | |
|---|---|---|---|
| 3,985,957 | 10/1976 | Torn . | |
| 4,010,324 | 3/1977 | Jarvis et al. . | |
| 4,052,564 | 10/1977 | Propst et al. . | |
| 4,098,370 | 7/1978 | McGregor et al. . | |
| 4,366,882 | 1/1983 | Parker | 181/30 |
| 4,566,557 | 1/1986 | Lemaitre | 181/150 |
| 4,761,921 | 8/1988 | Nelson . | |
| 5,192,342 | 3/1993 | Baron et al. . | |
| 5,360,469 | 11/1994 | Baron et al. . | |

*Primary Examiner*—Khanh Dang

*Attorney, Agent, or Firm*—Adelberg, Rudow et al.

[57] ABSTRACT

A plenum mounted, flat metal panel diaphragm masking loudspeaker includes a flat, stamped sheet metal frame which has a deployed state and an undeployed, flat state well suited to storage or shipping. A large, movable tab at the bottom of the frame is weakened by a series of small apertures and forms a hinge or fold line. Electrical accessories including a transformer, a rotary switch for selecting transformer taps and signal connections are included in an enclosed box mounted on the foldable tab. The flat panel masking loudspeaker is shipped flat in the undeployed state and then the large tab is deployed by being folded outwardly before installing the flat panel masking loudspeaker in a ceiling plenum. During installation, the tab is folded along the hinge or fold line out to approximately 90° with respect to the rest of the masking speaker frame, the entire assembly is then held overhead by the installer and is positioned above the suspended ceiling T-bar supports, within the plenum, whereupon the assembly is lowered or pushed downwardly and is held in place by one or more spring clips gripping the speaker frame and the ceiling T-bar supports. Alternatively, the frame may be suspended within the plenum by one or more small chains from the building trusses. Speaker diaphragm panel materials are preferably limited to those that are light in weight, stiff and substantially fire proof, such as aluminum. The flat panel diaphragm is driven by one or more exciters to produce a substantially omnidirectional polar radiation pattern, evenly distributing masking sound through the plenum area for radiation down into a workspace.

30 Claims, 5 Drawing Sheets

PLENUM MOUNTED, FLAT PANEL MASKING LOUDSPEAKER SYSTEM AND METHOD FOR MOUNTING A MASKING LOUDSPEAKER IN A CEILING PLENUM

BACKGROUND OF THE INVENTION

1. Field of the Invention

The loudspeaker system and method of the present invention relate to a sound system for generating diffuse background or masking noise in an office area or the like, generally for the purpose of covering or masking conversation in an open area and providing speech privacy to people sharing a large, open workspace. The loudspeaker system of the present invention is ideally suited for mounting in an overhead plenum, above a suspended tile ceiling or behind an architectural barrier separating a plenum from a workspace.

2. Discussion of the Prior Art

Architects and designers of large office spaces have largely abandoned the practice of placing each desk in its own small office. Instead, modern office arrangements usually include large, spacious, open floors shared by many desks, thereby (theoretically) providing enhanced efficiency and an informal atmosphere. One drawback of the new open plan office design is that privacy of conversation automatically provided by smaller individual offices is lost, since the conversation between workers or over the telephone is readily overheard and may provide a distracting intrusion not appreciated by adjacent workers. Distractions such as operation of business machines, telephones ringing and other extraneous noises may tend to lower productivity. The open plan concept has gone beyond the office and is finding acceptance in hospital patient rooms where, again, privacy is lost. In the hospital ward, each patient should be isolated from the sounds of other patients including conversations and TV sets. In schools, the problem of audible distractions is also difficult to address because one large room may be shared by several classes. Each classes' space must be acoustically contiguous (so that each student in a class can hear the teacher) but must also be acoustically separated from adjacent classes to minimize distractions.

The use of sound absorbing acoustical material is a basic element in the design of work spaces. Carpeting, wall and ceiling acoustical treatments are common; additionally, panels and sound barriers are casually arranged to aid in separation of space. These measures cannot provide an adequate solution, however, since they do not provide a sufficient amount of attenuation for all distracting noises.

Most open plan office spaces include a suspended ceiling where space above the ceiling is defined as a plenum in which office services are channeled. Sprinkler pipes, water pipes, air conditioning duct work, electrical conduits, telephone cables, computer network cables and many other mechanical and electrical services are routed through the plenum space.

It is well known to provide background noise generation systems for the purpose of masking conversations or other distracting noises. Several problems are confronted when attempting to design and install effective background noise masking systems, however.

The masking noise should be uniformly distributed throughout the space in order to achieve satisfactory masking results. Ideally, background masking noise is a broad spectrum, uniformly distributed, diffuse sound field of uniform intensity and is substantially imperceptible to those in the treated space. If the masking noise is not uniformly distributed or diffused throughout the work space, masking tends to be less effective in a first area and more effective in a second area; a person walking through a work space from the first area to the second area is subjected to different intensities of masking noise and thus is more likely to become conscious of and distracted by the masking noise. Because of this problem, masking systems employing loudspeakers radiating directly into the work space from the ceiling tend to be particularly ineffective and distracting.

There are prior art systems utilizing conventional sound system components (such as cone diaphragm loudspeakers) installed in the plenum spaces above the open plan office ceilings to position the speakers in an attempt to use plenum space as a mixing chamber for masking noise where, in theory, the masking noise from several loudspeakers mixes and then filters down uniformly through the ceiling and into the office space. Unfortunately, such installations tend to provide poor masking performance since the plenum is usually obstructed by duct work or the like and since the plenum may or may not be sufficiently acoustically reflective to provide adequate mixing. Insulated air conditioning ducts and other equipment in the plenum tends to interfere with distribution and mixing of the sound and provide poor mixing performance. By way of example, U.S. Pat. No. 3,985,957, to William R. Torn, discloses a structure including clusters of speakers mounted in the plenum above an office space. Each cluster has two cone diaphragm speakers in a prism-shaped cabinet symmetrically disposed about a vertical axis. The sound masking system of Torn requires that a plurality of clusters be employed to cover quiet regions which may develop below a cluster. Torn's sound masking system requires that the plenum region be relatively free of obstructing materials which would tend to interfere with the reflecting and mixing of masking sound before propagation down through the ceiling tiles into the office space. As shown in FIGS. 1*a*–1*h* included herewith, cone diaphragm loud speakers necessarily provide a substantially more directional output at higher frequencies (as compared to lower frequencies) thereby providing frequency dependent masking sound radiation (FIGS. 1*a*–1*h* are polar plots of sound pressure level as a function of angle at 125 Hz, 250 Hz, 500 Hz, 1000 Hz, 2000 Hz, 4000 Hz, 8000 Hz and 16000 Hz, respectively, for a conventional loudspeaker with a cone diaphragm). Since it is desired to provide a rather uniform pink or white noise for masking of conversation or the like, frequency dependant behavior may prove to be troublesome for an installer in trying to implement the sound masking system. Additionally, an installer working with the Torn system is required to suspend a plurality of loudspeaker cabinets having what may be very heavy loudspeaker drivers and a cabinet in the plenum space. As shown in Torn FIGS. 1, 2 and 3, the loudspeaker cabinets or clusters are preferably suspended from the ceiling above the plenum by chain, cable or the like and so must be held in place while being installed. Another problem associated with the Torn system is that most loudspeaker drivers are fabricated from pulp paper or plastic cone materials and so tend to be flammable. Most jurisdictions require that Underwriters Laboratories (UL) approved components be installed in a plenum, since any fire breaking out in the plenum space could travel quickly through a building and may provide a potentially undetectable, lethal hazard.

U.S. Pat. No. 4,010,324 to Jarvis et al. discloses a background noise masking system intended to overcome some of the difficulties encountered with the Torn system by providing pairs of loudspeaker drivers driven by a noise signal generator having first, second and third time delay blocks where a first set of loudspeaker drivers is driven by the noise generator without delay, a second set of drivers is driven by the noise generator signal having one time delay, the third set of drivers is driven by a signal having two stages of time delay and the fourth set of drivers is driven by a signal having three stages of time delay. Accordingly, the noise, in theory, would tend to be uncorralated from place to place in the open plan office, permitting a more uniform and diffuse sound field, thereby enhancing the psycho-acoustic result as perceived by workers in the office space, since there is relatively low correlation between the noise masking signals coming from any two speakers.

The Jarvis et al. system still has a number of the disadvantages alluded to above, namely, the installer is required to install a number of directional, heavy loudspeaker drivers in the plenum of a suspended ceiling where each of the drivers includes either a paper or plastic cone (and hence is flammable) and each of the drivers must be suspended in some fashion in a ceiling tile or the like.

Others have attempted to overcome difficulties with plenum mounted noise masking loudspeakers by attaching the masking noise system drivers to other parts of the office. In particular, U.S. Pat. No. 4,098,370 to McGregor et al. discloses a system in which a diaphragm speaker and transfer member are directly attached to a structural member such as an office wall, to force vibrations through the structural member. The McGregor et al. system thus requires an installer to determine the frequency response of a wall or other structural member which was never intended to be an acoustic transducer and adjust the masking noise spectrum to provide a uniform sound distribution of pink noise or the like from the structural member. This puts the installer in the position of having to perform acoustic tests on walls, doors and ceilings in an effort to permanently install an effective noise masking system. For a number of reasons, the McGregor system has not found success in the marketplace.

Others have provided masking sound generators which are affixed to * doors or the like. In particular, U.S. Pat. No. 4,052,564 to Propst et al. discloses a masking sound generator resembling a ball which fits upon the top of a door, cubicle partition or the like. The loudspeaker within the noise masking system radiates upwardly or downwardly into a circumferential slot and therefore provides a circular band of noise masking radiation. Since the sound masking generator of the Propst et al. patent must be mounted where it can be easily seen, it would be difficult to make the sound masking system more conspicuous. Others have attempted to overcome problems associated with having a conspicuous external cabinet by incorporating additional and possibly unnecessary features. In particular, U.S. Pat. No. 5,360,469 to Baron et al. discloses an apparatus for enhancing the environmental quality of work spaces combining a high efficiency air filter with a fragrance producing element, blower and sound masking device for generating pink noise, all in a single cabinet, thereby providing a number of different, allegedly work enhancing stimuli. While the Barron et al. apparatus may be pleasant and provide some novelty value in the home, it would hardly be suitable for use in an office, since it requires desk top space and therefore would likely to be used only in and among cubicles and not between them.

There is a need, therefore, for an effective sound masking system which provides a broad-band, diffused sound field but is easily mounted in a plenum.

OBJECTS AND SUMMARY OF THE INVENTION

Accordingly, it is a primary object of the present invention to overcome the above mentioned difficulties by providing a flat panel masking loudspeaker adapted to be mounted in a plenum above a suspended ceiling.

Another object of the present invention is to provide a light weight loudspeaker readily adapted to be held over head by the installer for mounting in a plenum.

Another object of the present invention is to provide a relatively small noise masking loudspeaker which is quickly and easily installed in a plenum or other overhead space for providing a diffuse sound field.

Yet another object of the present invention is to provide an all metal loudspeaker in a fire proof structure readily adapted to be mounted in the plenum in accordance with prevailing fire codes.

Another object of the present invention is to provide an evenly distributed and diffuse sound field in a cluttered plenum, without requiring the installer to redistribute the other equipment already routed through the plenum.

The aforesaid objects are achieved individually and in combination, and it is not intended that the present invention be construed as requiring two or more of the objects to be combined unless expressly required by the claims attached hereto.

The applicant has discovered that flat panel loudspeakers are particularly well suited to generating substantially omnidirectional masking noise and, if properly positioned in a plenum, can form the driving element in a particularly effective noise masking system. The noise masking system of the present invention employs one or more plenum mounted, flat panel masking loudspeakers; the flat panel loudspeaker driver is similar to that disclosed in international patent application PCT/GB96/02153 (WO 97/09843) to Henry Azeema et al. (the entire disclosure of which is incorporated by reference), but is mounted in a structure and by a method which overcomes many problems associated with the prior art.

In accordance with the present invention, a flat, stamped sheet of metal serves as a frame for a flat panel loudspeaker and also supports electrical circuitry associated with adjusting volume and the like. The flat panel loudspeaker is attached to the frame by various fasteners. A large tab at the bottom of the frame is weakened by a series of small apertures and forms a hinge or fold line; the tab has a deployed state and an undeployed, flat or coplanar state. Electrical accessories including a transformer, a rotary switch for selecting transformer taps and signal connections are included in an enclosed box mounted on the foldable tab. The box is secured with one or more fasteners (e.g., screws) at a first end and hinges, preferably, on tabs at a second end opposing the first end. The box is affixed using a resilient gasket or the like to prevent rattling. The masking loudspeaker system is shipped flat with the tab in the undeployed, coplanar state and then the tab is folded outwardly into a substantially perpendicular state before installing the flat panel masking loudspeaker in a ceiling plenum.

During installation, the larger lower tab is folded along the hinge or fold line out to approximately 90° with respect to the rest of the masking speaker frame, whereupon the entire assembly is held overhead by the installer and is positioned above the drop ceiling structure suspended ceiling T-bar supports, within the plenum, whereupon the assembly is lowered or pushed downwardly and is held in place by one or more spring clips gripping the speaker frame and the ceiling T-bar supports. Alternatively, the frame may be suspended within the plenum by one or more small chains from the building trusses.

The retained cover box fastener is loosened, thereby allowing the cover box to be opened so that the installer can make the wiring connections between the flat panel loudspeaker and the noise masking signal distribution system. The installer can then adjust the rotary switch to select among a number of impedance matching transformer taps, thereby allowing the installer to select the input impedance of the noise masking loudspeaker for the purpose of either adjusting the volume of the individual loudspeaker or matching the impedance of the loudspeaker to the overall noise masking signal distribution system. The plenum mounted noise masking loudspeaker of the present invention is scalable in size; larger speaker panels can be employed to provide lower frequency capability. Alternatively, the mounting frame can be made of any stiff, flat and malleable material. Metals are preferable in that most metals are non-flammable and steel is the material of the preferred embodiment since steel has a high temperature tolerance. The speaker flat panel diaphragm is suspended in a large aperture within the speaker frame by chains, rings, S-hooks or the like. Alternatively, the speaker flat panel diaphragm may be rigidly or compliantly attached at two or more points to the speaker frame. In another embodiment, the speaker flat panel diaphragm is mounted by compliant materials such as foam plastics with adhesive on each side (as is used for foam tape or foam insulation). The flat panel loudspeaker of the present invention employs one or more exciters for exciting the panel as disclosed in international patent application PCT/GB96/02145 to Henry Azeema et al., the entire disclosure of which is incorporated by reference. One or more exciters may be mounted on the speaker flat panel diaphragm which is driven to produce a substantially omni-directional polar radiation pattern, evenly distributing masking sound through the plenum area for radiation down into a workspace.

The number of exciters chosen is primarily a function of the physical size of the flat panel and economic considerations. Speaker panel materials are preferably limited to those that are light in weight, stiff and substantially fire proof. Aluminum is preferred, since aluminum panels or sheets are relatively easy to cut and fabricate, are inexpensive and are not flammable.

The above and still further objects, features and advantages of the present invention will become apparent upon consideration of the following detailed description of a specific embodiment thereof, particularly when taken in conjunction with the accompanying drawings, wherein like reference numerals in the various figures are utilized to designate like components.

DESCRIPTION OF THE PREFERRED EMBODIMENT

As noted above, the applicant has discovered that flat panel loudspeakers are particularly well suited to generating a nearly ideal, substantially omni-directional masking noise radiation pattern, as shown in the polar plots of FIGS. 2*a*–2*h*. When properly positioned in a plenum using the structure and method of the present invention, a flat panel loudspeaker forms the driving element in a particularly effective noise masking system. FIGS. 2*a*–2*h* are polar plots of sound pressure level as a function of angle at 125 Hz, 250 Hz, 500 Hz, 1000 Hz, 2000 Hz, 4000 Hz, 8000 Hz and 16000 Hz, respectively, for the flat panel diaphragm noise masking loudspeaker of the present invention. Also provided for purposes of comparison are FIGS. 1*a*–1*h*, polar plots of sound pressure level as a function of angle at 125 Hz, 250 Hz, 500 Hz, 1000 Hz, 2000 Hz, 4000 Hz, 8000 Hz and 16000 Hz, respectively, for a conventional loudspeaker with a cone diaphragm. Examination of the plots of FIGS. 2*a*–2*h* shows that the non-flammable, aluminum, flat panel loudspeaker of the present invention is substantially omni-directional at 125 Hz, 250 Hz, 4000 Hz, 8000 Hz and 16000 Hz, and may properly be characterized as either omni-directional or bipolar (i.e., radiating in two broad lobes), for the frequencies of 500 Hz, 1000 Hz and 2000 Hz. The polar plots for the conventional loudspeaker (as shown in FIGS. 1*a*–1*h*), by way of contrast, illustrate the above-mentioned deleterious tendency of radiating with increasing directionality or beaming with increasing frequencies, especially in the upper frequency ranges which are essential to projecting broad spectrum and effective is masking noise.

The broad frequency range and substantially omni-directional characteristic of the noise masking loudspeaker of the present invention is a result of the novel structure and mounting method of the present invention as shown in FIGS. 3–7.

By mounting the flat panel perpendicularly to the plane of the ceiling so that it projects into the plenum, a light weight, substantially fire proof, efficient, substantially omni-directional noise masking loudspeaker system is provided, but the system of the preferred embodiment should be easily mounted overhead by an installer, on the crossing T-bar supports usually supporting drop ceilings. This configuration, shown in FIGS. 5–7, would be difficult and expensive to pack and ship. Accordingly, the noise masking loudspeaker of the present invention is adapted to be shipped flat and deployed at the site by the installer, as will be described in greater detail below.

Figure 1A:
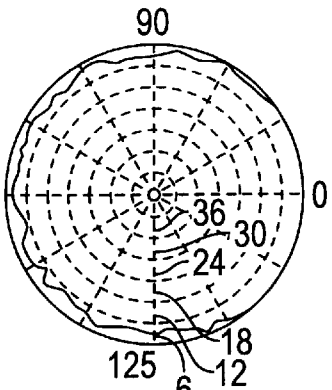
FIG. 1A (PRIOR ART)
FIGS. 1*a*–1*h* are polar plots of sound pressure level as a function of angle at 125 Hz, 250 Hz, 500 Hz, 1000 Hz, 2000 Hz, 4000 Hz, 8000 Hz and 16000 Hz, respectively, for a conventional loudspeaker with a cone diaphragm.
Figure 1B:
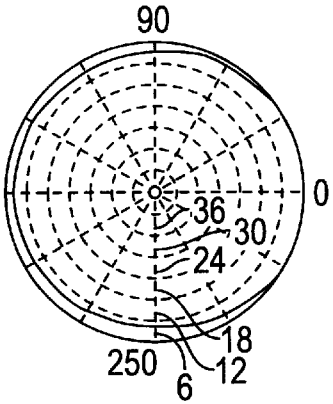
FIG. 1B (PRIOR ART)
Figure 1C:
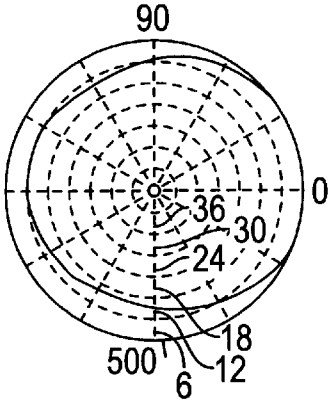
FIG. 1C (PRIOR ART)
Figure 1D:
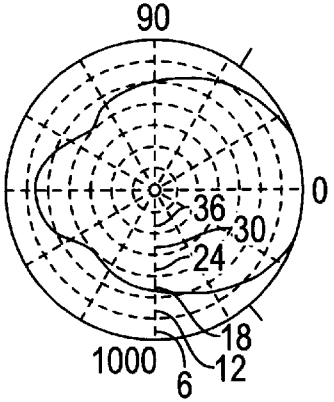
FIG. 1D (PRIOR ART)
Figure 1E:
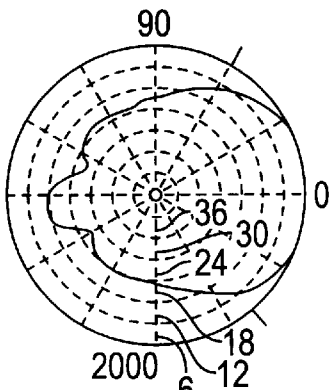
FIG. 1E (PRIOR ART)
Figure 1F:
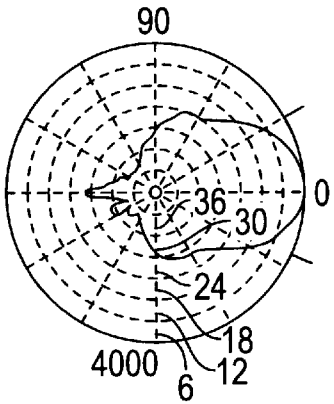
FIG. 1F (PRIOR ART)
Figure 1G:
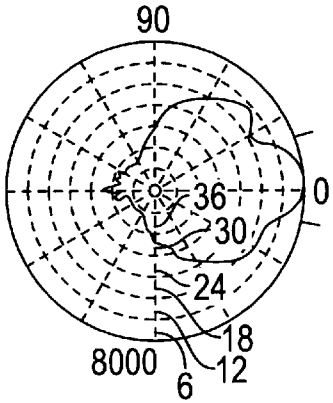
FIG. 1G (PRIOR ART)
Figure 1H:
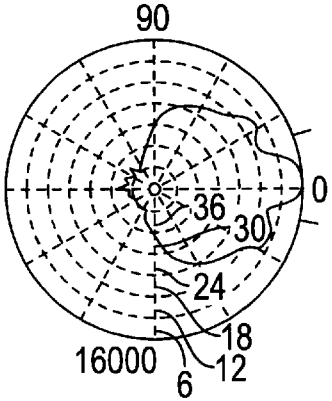
FIG. 1H (PRIOR ART)
Figure 2A:
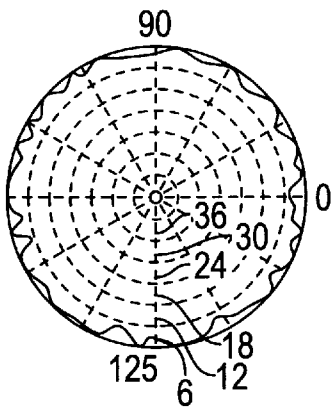
FIGS. 2*a*–2*h* are polar plots of sound pressure level as a function of angle at 125 Hz, 250 Hz, 500 Hz, 1000 Hz, 2000 Hz, 4000 Hz, 8000 Hz and 16000 Hz, respectively, for the flat panel diaphragm noise masking loudspeaker of the present invention.
Figure 2B:
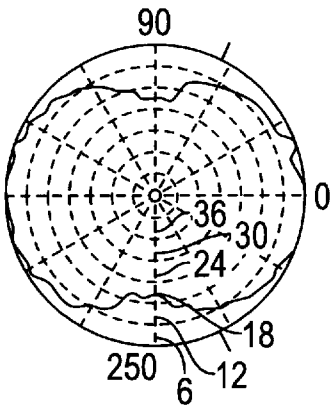
Figure 2C:
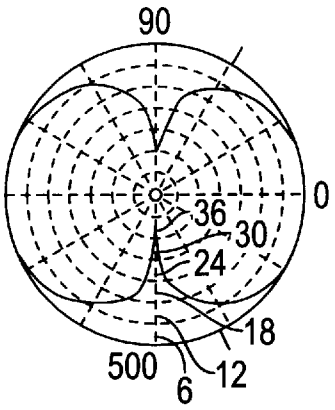
Figure 2D:
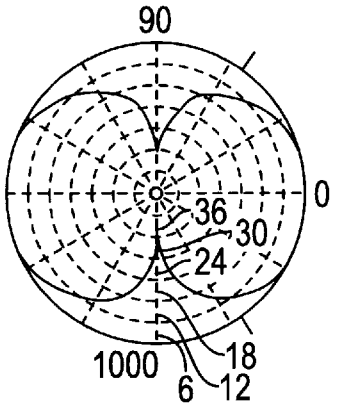
Figure 2E:
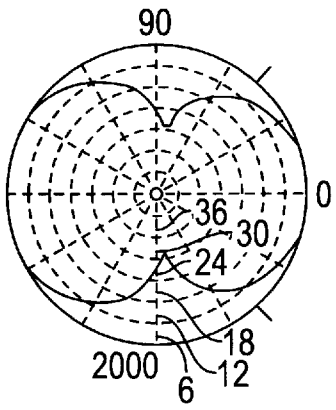
Figure 2F:
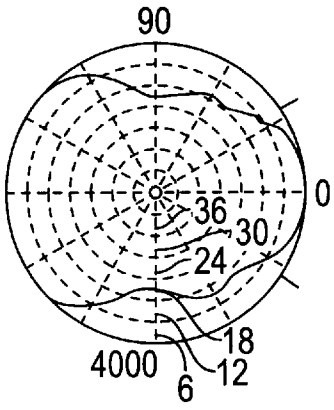
Figure 2G:
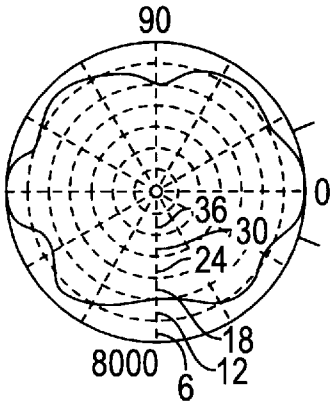
Figure 2H:
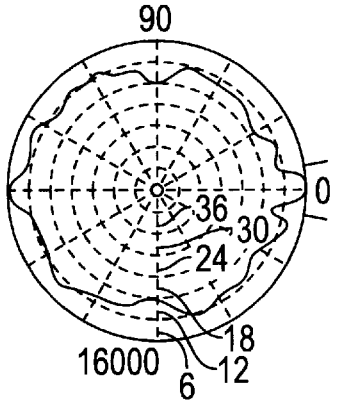
Figure 4:
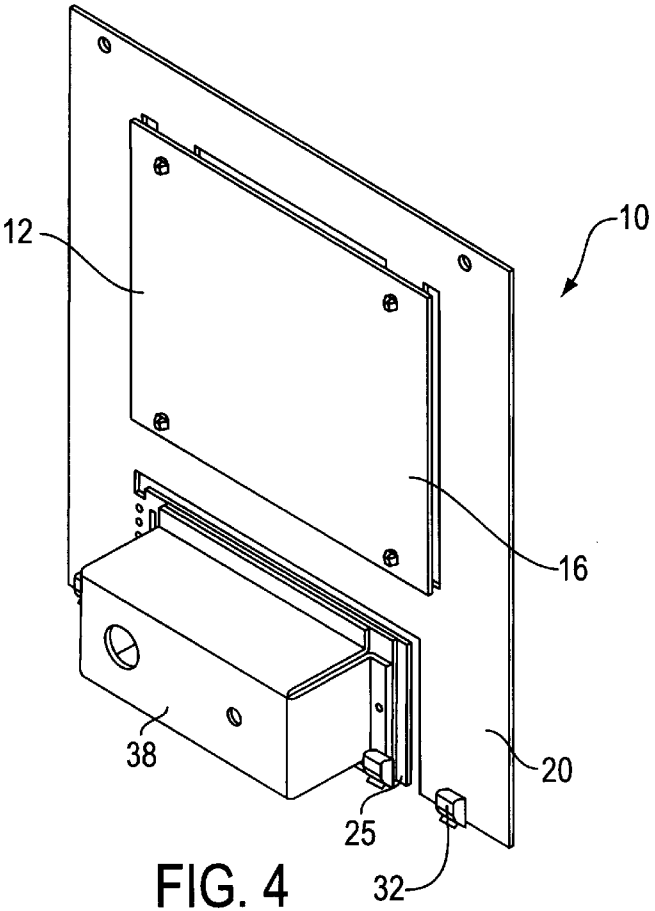
FIG. 4 is a perspective view of the flat panel masking loudspeaker of the present invention, illustrating the support tab in the coplanar, undeployed position.
Figure 3:
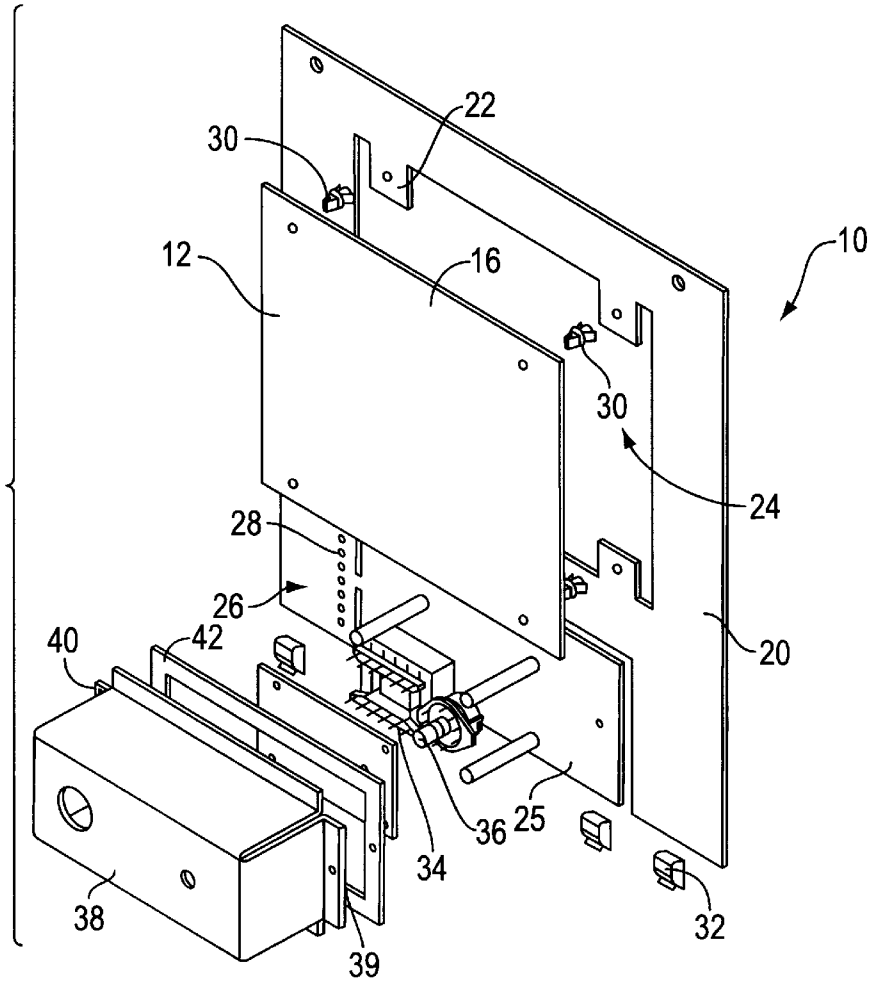
FIG. 3 is an exploded view in perspective of the flat panel masking loudspeaker of the present invention, illustrating the support tab in the coplanar, undeployed position.
Figure 6:
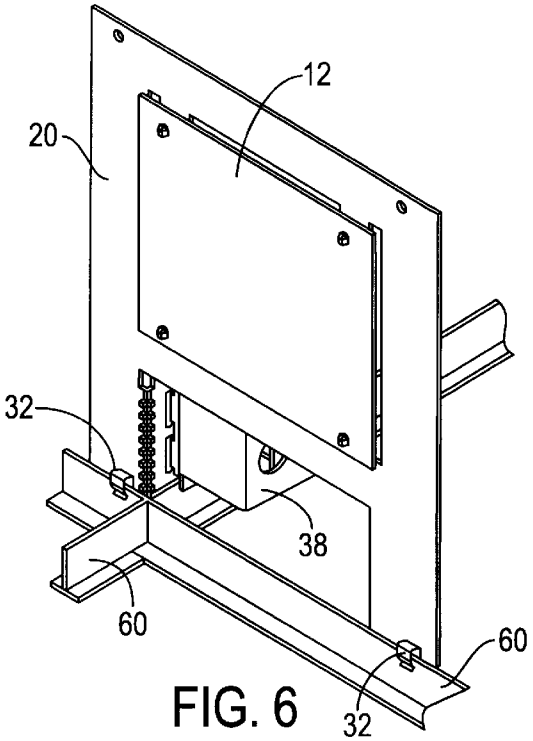
FIG. 6 is a perspective view of the front side of the flat panel masking loudspeaker of the present invention installed and supported on the T-rail of a drop-ceiling structure, showing the support tab in the deployed position.
Figure 7:
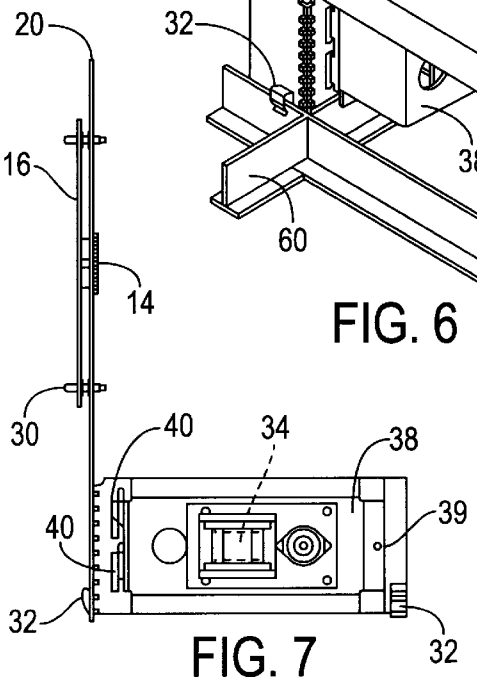
FIG. 7 is a side view, in elevation, of the flat panel masking loudspeaker of the present invention, showing the support tab in the deployed position.
Figure 5:
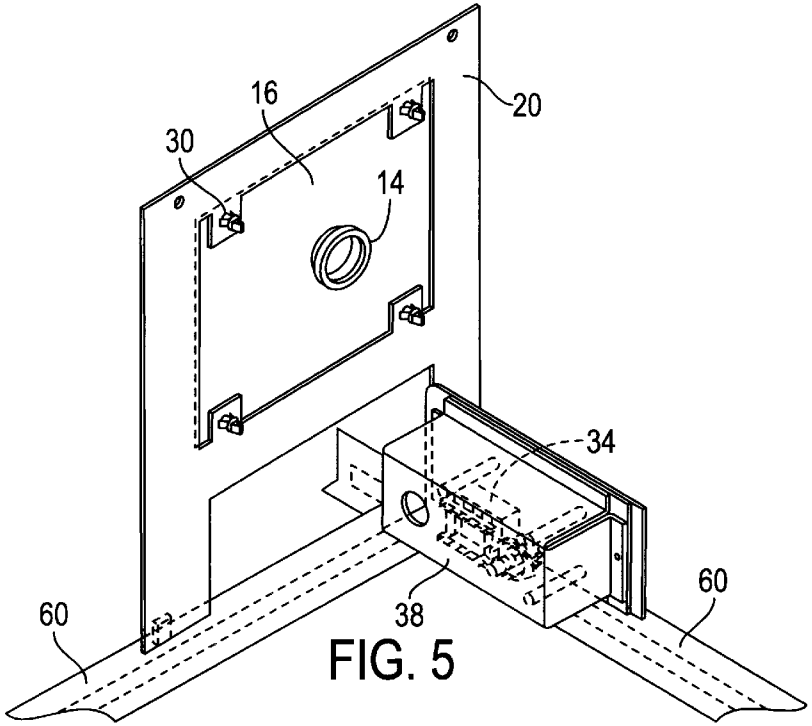
FIG. 5 is a perspective view of the rear side of the flat panel masking loudspeaker of the present invention installed and supported on the T-rail of a drop-ceiling structure, showing the support tab in the deployed position.

Turning now to FIGS. 3 and 4, an undeployed noise masking loudspeaker system 10 includes a panel form loudspeaker 12 including an exciter 14 and a substantially planar, panel form aluminum diaphragm 16 which is preferably rectangular seven inches tall and eight inches wide. Exciter 14 (best seen in FIGS. 5 and 7) is positioned to impart bending waves in aluminum panel form diaphragm 16. Noise masking loudspeaker system 10 has a substantially planar steel frame member 20 including at least first and second panel form loudspeaker supports 22 disposed proximate an aperture 24, and a tab member 25 which is, when undeployed, coplanar with substantially planar frame member 20 and carried by a hinge segment 26 defined by a linear array of weakening through holes 28. Tab member 25 is hingedly pivotable about hinge segment 26 to project substantially transversely from substantially planar frame member 20 as shown in FIGS. 5–7, and panel form loudspeaker 12 is carried by planar frame member 20 and affixed to panel form loudspeaker supports 22 by resilient stand-off fasteners 30 such that panel form loudspeaker 12 is positioned to radiate sound through planar frame member aperture 24 when exciter 14 is energized. In the preferred embodiment illustrated in FIGS. 3–7, a frame member support attachment or spring clip 30 is affixed to frame member 20 and is adapted to support the frame in the plenum space, proximate the workspace.

Preferably a flat, stamped sheet of steel or other metal is used in making frame member 20 and supports electrical circuitry. The flat panel loudspeaker 12 is attached to the frame 20 by various fasteners (e.g., stand-off fasteners 30). Tab member 25 at the bottom of frame 20 is weakened by small apertures 28 and forms a hinge or fold line 26; the tab has a deployed state (as shown in FIGS. 5, 6 and 7) and an undeployed, flat or coplanar state (as shown in FIGS. 3 and 4). Electrical accessories including a transformer 34, a rotary switch 36 for selecting transformer taps and signal connections are included in an enclosed box 38 mounted on the foldable-tab 25.

Transformer 34 is a multi-tap impedance matching transformer and tap selection rotary switch 36 is electrically connected to the taps; the transformer and switch are electrically connected to and serve as an interface between exciter 14 and a noise masking signal distribution system. Transformer 34 optionally serves as a step down transformer for connection with a higher voltage (e.g., seventy volt) masking signal distribution system.

Box 38 is secured with one or more fasteners (e.g., screws) at a first end 39 and hinges, preferably, on small box tabs 40 at a second end opposing first end 39. The box 38 is affixed using a resilient gasket 42 or the like to prevent rattling. As best seen in FIGS. 3 and 4, masking loudspeaker system 10 is shipped flat with large lower tab 25 in the undeployed, coplanar state and then tab 25 is folded outwardly into a substantially perpendicular state (best seen in FIGS. 5–7) before installing the flat panel masking loudspeaker system 10 in a ceiling plenum, in accordance with the method of the present invention, as will be described in greater detail, hereinbelow.

Figure 8:
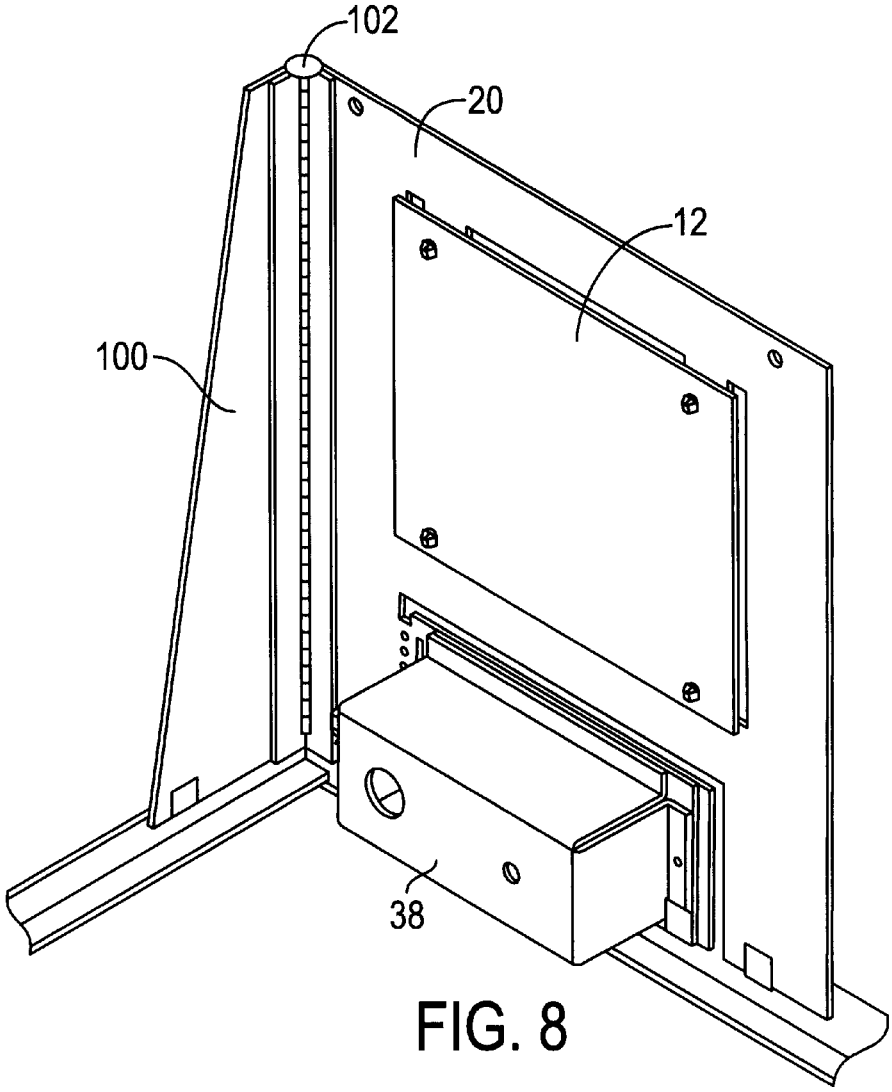
FIG. 8 is a perspective view of the rear side of an alternative embodiment of the flat panel masking loudspeaker of the present invention installed and supported on the T-rail of a drop-ceiling structure, showing the hinged support wing in the deployed position.
Figure 9:
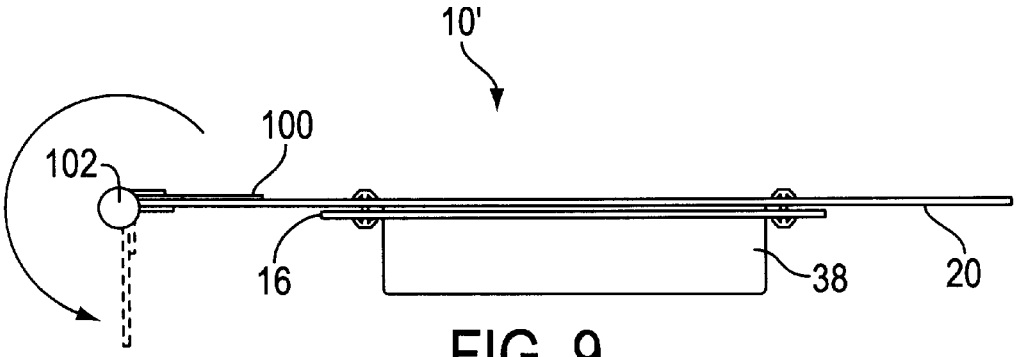
FIG. 9 is a top view, in elevation, of the flat panel masking loudspeaker of FIG. 8, showing the hinged support wing in the coplanar, undeployed position.

An alternative embodiment is illustrated in FIG. 8, a perspective view of the rear side of flat panel masking loudspeaker 10' installed and supported on the T-rail of a drop-ceiling structure, showing a hinged, large tab member or support wing 100 in the deployed position. FIG. 9 is a top view, in elevation, of flat panel masking loudspeaker 10', showing hinged support wing 100 in a substantially coplanar, undeployed position. Large tab member or support wing 100 is carried by frame member 20 and hingedly pivoted about an elongate piano-style hinge segment 102 to the deployed position shown in phantom lines in FIG. 9. In the embodiment of FIGS. 8 and 9, box 38 is preferably not moved from the coplanar position, since hinged tab member or support wing 100 is pivoted out to the transverse supporting position shown in FIG. 8.

During installation, the hinged member (e.g., lower tab 25) is folded along the hinge (or fold line 26) out to approximately 90° with respect to the rest of the masking speaker frame 20, whereupon the entire assembly is held overhead by the installer and is positioned above the drop ceiling structure suspended ceiling T-bar supports 60 (e.g., as best seen in FIGS. 5 and 6), within the plenum, whereupon the assembly is lowered or pushed downwardly and is held in place by one or more spring clips 32 gripping the speaker frame 20 and the ceiling T-bar supports 60. Alternatively, the frame 20 may be suspended within the plenum by one or more small chains (not shown) and suspended from the building trusses.

The retained fastener fastening cover box 38 is loosened, thereby allowing the cover box 38 to be opened so that the installer can make the wiring connections between the flat panel loudspeaker 12 and the noise masking signal distribution system. The installer can then adjust the rotary switch 36 to select among a number of impedance matching transformer taps, thereby allowing the installer to select the input impedance of the noise masking loudspeaker for the purpose of either adjusting the volume of the individual loudspeaker or matching the impedance of the loudspeaker to the overall noise masking signal distribution system.

More generally, the method for installing the noise masking loudspeaker system 10 in a plenum comprises the steps of: unpacking a flat panel masking loudspeaker system 10 having a flat panel loudspeaker support 20 carrying a tab or movable member 25 in an initially coplanar, flat position (as shown in FIG. 4.); deploying the movable member 25 by rotating the movable member, preferably about a hinge axis (e.g., along the line of weakening holes 28) to make a flat panel loudspeaker support having a deployed perpendicular movable member (e.g., as shown in FIGS. 5–7); and affixing the flat panel loudspeaker support 20 into the plenum.

The method for using the flat panel masking noise loudspeaker of the present invention is for radiating masking noise within a plenum and into an adjacent workspace. The plenum has a boundary (e.g., a ceiling) with a substantial length and width coextensive with a first plane. Noise is also radiated into a workspace next to the plenum, preferably through apertures in the ceiling. The method for using masking noise system 10 comprising the steps of positioning flat panel masking loudspeaker system 10 with flat panel loudspeaker diaphragm 12 in a second plane that is substantially perpendicular orientation to the first plane of the ceiling or other plenum boundary, with the diaphragm 12 projecting into the plenum. Next, the loudspeaker 12 is used to generate substantially omni-directional masking noise by exciting the flat panel diaphragm 16 to propagate masking noise substantially throughout the plenum and into the adjacent workspace.

The plenum mounted noise masking loudspeaker system 10 is scalable in size; larger speaker panels or diaphragms (e.g., like diaphragm 16) can be employed to provide lower frequency capability. Alternatively, the mounting frame 20 can be made of any stiff, flat and malleable material. Metals are preferable in that most metals are non-flammable and steel is the material of the preferred embodiment since steel has a high temperature tolerance. As noted above, flat panel diaphragm 16 is suspended in aperture 24 within the speaker frame by stand-off fasteners 30, or by chains, rings, S-hooks, so that the speaker flat panel diaphragm is rigidly or compliantly attached or suspended, preferably at two or more points, to speaker frame 20. In another embodiment, the speaker flat panel diaphragm 16 is mounted by compliant materials such as foam plastics with adhesive on each side (as is used for foam tape or foam insulation). The flat panel loudspeaker 12 employs one or more exciters 14 for exciting the panel as disclosed in international patent application PCT/GB96/02145 to Henry Azeema et al., the entire disclosure of which is incorporated by reference. One or more exciters 14 may be mounted on the speaker flat panel diaphragm 16 which is driven to produce a substantially omni-directional polar radiation pattern (e.g., as shown in FIGS. 2*a*–2*h*), evenly distributing masking sound through the plenum area for radiation down into a workspace. In one experimental embodiment, two Peerless™ brand exciters wired in series were used to excite a substantially rectangular panel having a height of approximately seven inches and a width of approximately eight inches.

The number of exciters 14 chosen is primarily a function of the physical size of the flat panel and economic considerations. Speaker panel materials are preferably limited to those that are light in weight, stiff and substantially fire proof. Aluminum sheet of 0.031 inch thickness is preferred, since aluminum panels or sheets are relatively easy to cut and fabricate, are inexpensive and are not flammable.

In an alternative embodiment, a panel diaphragm of 3 mm thickness has a polycarbonate honeycomb core with fiberglass reinforced polycarbonate outer skins has provided the loudest output in testing to date, but other materials will also be used in future experiments. While the polycarbonate honeycomb panel is, in the strictest sense, flammable, it may generate a sufficiently small amount of smoke during combustion to permit Underwriters Laboratories (UL) approval for use in a plenum space. Less flammable plastic honeycomb materials are also being considered.

The embodiment illustrated in FIGS. 3–7 includes a hinge segment 26 connecting movable tab member 25 to frame member 20. Hinge segment 26 can be implemented as a weakened fold line (as shown) or as one or more hinges including and rotatable about one or more axially aligned hinge pins. Alternatively, tab member 25 can be a separate or separable member which is shipped flat with the other components of the noise masking loudspeaker 10 and is placed and affixed in perpendicular orientation (as shown in FIGS. 5–7) during installation.

Having described preferred embodiments of a new and improved structure and method, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A noise masking loudspeaker system adapted for mounting in a plenum space for radiating masking noise into a workspace, comprising:

a panel form loudspeaker including an exciter and a substantially planar panel form diaphragm; said exciter being positioned to impart bending waves in said panel form diaphragm;

a substantially planar frame member including at least first and second panel form loudspeaker supports disposed proximate an aperture, and a tab member being coplanar with said substantially planar frame member and carried by a hinge segment;

said tab member being hingedly pivotable about said hinge segment to project substantially transversely from said substantially planar frame member; and said panel form loudspeaker being carried by said planar frame member and affixed to said panel form loudspeaker supports, wherein said panel form loudspeaker is positioned to radiate sound through said planar frame member aperture when said exciter is energized.

2. The noise masking loudspeaker system of claim 1, further comprising a frame member support attachment affixed to said substantially planar frame member and adapted to support the frame in the plenum space, proximate the workspace.

3. The noise masking loudspeaker system of claim 2, wherein said frame member support attachment affixed to said substantially planar frame member comprises a spring clip; said plenum being bounded by a drop ceiling structure including a T-bar; and said spring clip being sized to resiliently hold said T-bar.

4. The noise masking loudspeaker system of claim 3, wherein said frame member support attachment affixed to said substantially planar frame member further comprises a second spring clip; said T-bar being disposed in a rectangular grid having perpendicular segments; said first spring clip being positioned on a first segment of said T-bar and said second spring clip being positioned on a second segment of said T-bar disposed in perpendicular relation to said first segment of said T-bar.

5. The noise masking loudspeaker system of claim 1, wherein said substantially planar frame member is made of metal.

6. The noise masking loudspeaker system of claim 5, wherein said frame member metal is steel.

7. The noise masking loudspeaker system of claim 1, wherein said substantially planar panel form diaphragm is made of metal.

8. The noise masking loudspeaker system of claim 7, wherein said panel form diaphragm metal is aluminum.

9. A noise masking loudspeaker system adapted for compact shipping and storage and adapted for subsequent deployment and mounting in a plenum space for radiating masking noise into a workspace, comprising:

a panel form loudspeaker including an exciter and a substantially planar panel form diaphragm; said exciter being positioned to impart bending waves in said panel form diaphragm;

a substantially planar frame member including at least first and second panel form loudspeaker supports disposed proximate an aperture, and a tab member having a deployed state and an undeployed state wherein said tab member is coplanar with said substantially planar frame member;

said tab member being carried on said substantially planar frame member by a fold line segment and being hingedly pivotable about said fold line segment to project substantially transversely from said substantially planar frame member when in the deployed state; and said panel form loudspeaker being carried by said planar frame member and affixed to said panel form loudspeaker supports, wherein said panel form loudspeaker is positioned to radiate sound through said planar frame member aperture when said exciter is energized.

10. The noise masking loudspeaker system of claim 9, further comprising a frame member support attachment affixed to said substantially planar frame member and adapted to support the frame in the plenum space, proximate the workspace.

11. The noise masking loudspeaker system of claim 10, wherein said frame member support attachment affixed to said substantially planar frame member comprises a spring clip; said plenum being bounded by a drop ceiling structure including a T-bar; and said spring clip being sized to resiliently hold said T-bar.

12. The noise masking loudspeaker system of claim 11, wherein said frame member support attachment affixed to said substantially planar frame member further comprises a second spring clip; said T-bar being disposed in a rectangular grid having perpendicular segments; said first spring clip being positioned on a first segment of said T-bar and said second spring clip being positioned on a second segment of said T-bar disposed in perpendicular relation to said first segment of said T-bar.

13. The noise masking loudspeaker system of claim 9, wherein said substantially planar frame member is made of metal.

14. The noise masking loudspeaker system of claim 13, wherein said frame member metal is steel.

15. The noise masking loudspeaker system of claim 9, wherein said substantially planar panel form diaphragm is made of metal.

16. The noise masking loudspeaker system of claim 15, wherein said panel form diaphragm metal is aluminum.

17. The noise masking loudspeaker system of claim 9, wherein said substantially planar panel form diaphragm is made of plastic.

18. The noise masking loudspeaker system of claim 17, wherein said panel form diaphragm plastic is polycarbonate.

19. The noise masking loudspeaker system of claim 17, wherein said panel form diaphragm is a polycarbonate honeycomb structure covered on opposing sides with polycarbonate skins.

20. A method for installing a noise masking loudspeaker in a plenum, comprising the steps of:

(a) providing a flat panel masking loudspeaker system having a flat panel loudspeaker support and a movable member in an initially coplanar, flat position;

(b) deploying the movable member by moving the movable member to make a flat panel loudspeaker support having a deployed perpendicular movable member; and (c) affixing the flat panel loudspeaker support into the plenum.

21. The method of claim 20, wherein step (c) comprises (c)(1) suspending the flat panel masking loudspeaker system within the plenum, and (c)(2) affixing the flat panel masking loudspeaker system within the plenum by attaching the flat panel masking loudspeaker system to a drop-ceiling T-bar support.

22. A method for radiating masking noise within a plenum having a boundary with a substantial length and width coextensive with a first plane and into a workspace disposed in close proximity to said plenum, comprising the steps of:

(a) positioning a flat panel masking loudspeaker system having a flat panel loudspeaker diaphragm in a substantially perpendicular orientation to the plenum boundary and projecting into the plenum; and (b) exciting substantially omni-directional masking noise radiation from the flat panel diaphragm to propagate masking noise substantially throughout the plenum and into the workspace.

23. A noise masking loudspeaker system adapted for mounting in a plenum space for radiating masking noise into a workspace, comprising:

a panel form loudspeaker including an exciter and a substantially planar panel form diaphragm; said exciter being positioned to impart bending waves in said panel form diaphragm;

a substantially planar frame member including at least first and second panel form loudspeaker supports disposed proximate an aperture;

a tab member being initially coplanar with said substantially planar frame member and carrying electrical connections to said panel form loudspeaker;

said tab member being movable to project substantially transversely from said substantially planar frame member; and said panel form loudspeaker being carried by said planar frame member and affixed to said panel form loudspeaker supports, wherein said panel form loudspeaker is positioned to radiate sound through said planar frame member aperture when said exciter is energized.

24. The noise masking loudspeaker system of claim 23, wherein said panel form diaphragm is a honeycomb structure covered on opposing sides with skins.

25. The noise masking loudspeaker system of claim 24, wherein said panel form diaphragm is a plastic honeycomb structure covered on opposing sides with plastic skins.

26. The noise masking loudspeaker system of claim 25, wherein said panel form diaphragm is a polycarbonate honeycomb structure covered on opposing sides with polycarbonate skins.

27. A noise masking loudspeaker system adapted for mounting in a plenum space having a boundary, for radiating masking noise into a workspace divided from the plenum by the boundary, comprising:

a panel form loudspeaker including an exciter and a substantially planar panel form diaphragm; said exciter being positioned to impart bending waves in said panel form diaphragm;

a frame member including a panel form loudspeaker support; said frame member carrying electrical connections to said panel form loudspeaker;

said frame member being fastenable to the plenum space boundary to project substantially transversely from said boundary and into the plenum; and said panel form loudspeaker being carried by said frame member and affixed to said panel form loudspeaker support, wherein said panel form loudspeaker is positioned to radiate sound into the plenum when said exciter is energized.

28. The noise masking loudspeaker system of claim 27, wherein said panel form diaphragm is a honeycomb structure covered on opposing sides with skins.

29. The noise masking loudspeaker system of claim 27, further comprising a frame member support attachment affixed to said frame member and adapted to attach said frame member to the plenum space boundary, proximate the workspace.

30. The noise masking loudspeaker system of claim 29, wherein said frame member support attachment affixed to said frame member comprises a spring clip; said plenum boundary being a drop ceiling structure including a T-bar; and said spring clip being sized to resiliently hold said T-bar.

* * * * *